US010012190B2

(12) United States Patent
Ishikawa et al.

(10) Patent No.: US 10,012,190 B2
(45) Date of Patent: Jul. 3, 2018

(54) PUMP COVER

(71) Applicant: TOYOTA JIDOSHA KABUSHIKI KAISHA, Toyota-shi, Aichi-ken (JP)

(72) Inventors: Masami Ishikawa, Aichi-gun (JP); Kiyoshi Tawata, Toyota-shi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 71 days.

(21) Appl. No.: 14/712,518

(22) Filed: May 14, 2015

(65) Prior Publication Data

US 2015/0337784 A1 Nov. 26, 2015

(30) Foreign Application Priority Data

May 26, 2014 (JP) ..... 2014-108234

(51) Int. Cl.

| | |
|---|---|
| ***F02M 59/44*** | (2006.01) |
| ***F02M 39/02*** | (2006.01) |
| ***F02M 37/06*** | (2006.01) |
| *F02F 1/24* | (2006.01) |

(52) U.S. Cl.

CPC ..... *F02M 39/02* (2013.01); *F02M 37/06* (2013.01); *F02F 1/24* (2013.01); *F02M 2200/185* (2013.01)

(58) Field of Classification Search

CPC ..... F02M 2200/185; F02M 2200/03; F02M 35/04

USPC ..... 123/198 E, 195 C, 195 R

See application file for complete search history.

(56) References Cited

U.S. PATENT DOCUMENTS

| | | | | |
|---|---|---|---|---|
| 6,907,865 | B1 * | 6/2005 | Hanby | F02M 37/103 123/509 |
| 7,392,782 | B2 * | 7/2008 | Fujii | F02M 35/10144 123/195 C |
| 7,407,179 | B2 * | 8/2008 | Tsuruta | B62D 49/0671 123/198 E |
| 7,784,580 | B2 * | 8/2010 | Takahata | F02M 59/102 180/274 |
| 8,646,436 | B2 * | 2/2014 | Wakabayashi | F02F 7/006 123/509 |
| 2006/0005800 | A1 | 1/2006 | Fujii | |
| 2007/0089922 | A1 * | 4/2007 | Iwasaki | B62J 35/00 180/219 |
| 2008/0217089 | A1 * | 9/2008 | Takahata | F02M 59/102 180/271 |

(Continued)

FOREIGN PATENT DOCUMENTS

| | | |
|---|---|---|
| EP | 1 614 887 A2 | 1/2006 |
| JP | 2004-360581 A | 12/2004 |

(Continued)

OTHER PUBLICATIONS

Machine Translation of JP2004360581A, see "JP2004360581A_MachineTranslation.pdf".*

*Primary Examiner* — Long T Tran

(74) *Attorney, Agent, or Firm* — Oliff PLC

(57) ABSTRACT

A pump cover for a fuel pump is located at a position lateral to the fuel pump. The fuel pump is disposed on a cylinder head of an engine. The pump cover includes a plate and a rib. The plate is fixed to a side surface of the engine. The plate extends to a position lateral to the fuel pump disposed on the cylinder head. The rib protrudes from the plate, and is located superjacent to a pump mounting surface defined on the cylinder head.

5 Claims, 5 Drawing Sheets

(56) References Cited

U.S. PATENT DOCUMENTS

2009/0260602 A1* 10/2009 Kim ..... B60K 15/03504
123/519

FOREIGN PATENT DOCUMENTS

| | | | | | |
|---|---|---|---|---|---|
| JP | 2004360581 | A | * | 12/2004 | ..... F02M 39/02 |
| JP | 2007-138847 | A | | 6/2007 | |
| JP | 2008-032004 | A | | 2/2008 | |
| JP | 2008168737 | A | * | 7/2008 | |
| JP | 2013-174199 | A | | 9/2013 | |
| WO | 2007/057784 | A2 | | 5/2007 | |

* cited by examiner

PUMP COVER

INCORPORATION BY REFERENCE

The disclosure of Japanese Patent Application No. 2014-108234 filed on May 26, 2014 including the specification, drawings and abstract is incorporated herein by reference in its entirety.

BACKGROUND OF THE INVENTION

1. Field of the Invention

The invention relates to a pump cover.

2. Description of Related Art

Japanese Patent Application Publication No. 2013-174199 (JP 2013-174199 A) describes providing a pump cover at a position lateral to a fuel pump that is disposed on a cylinder head of an engine mounted on a vehicle. The pump cover protects the fuel pump from colliding with a component located near the fuel pump, when the component located near the fuel pump is displaced toward the fuel pump, for example, at the time of a collision of the vehicle.

When the component located near the fuel pump is displaced toward the fuel pump, the component may collide with the pump cover. In order to enable the pump cover to protect the fuel pump from a collision of the component, it is necessary to increase the strength of the pump cover to prevent deformation of the pump cover.

However, there is a limit to an increase in the strength of the pump cover. Therefore, when the component located near the fuel pump is displaced toward the fuel pump and then collides with the pump cover, the pump cover may be deformed due to the collision with the component. In some cases, the deformed pump cover comes into contact with the fuel pump, and thus a load is applied from the component through the pump cover to the fuel pump. In this case, the load may adversely affect the fuel pump.

SUMMARY OF THE INVENTION

The invention provides a pump cover configured to inhibit a load from a component located near a fuel pump, from acting on the fuel pump, for example, at the time of a collision of a vehicle.

A first aspect of the invention relates to a pump cover for a fuel pump, which is located at a position lateral to the fuel pump. The fuel pump is disposed on a cylinder head of an engine. The pump cover includes a plate and a rib. The plate is fixed to a side surface of the engine. The plate extends to a position lateral to the fuel pump disposed on the cylinder head. The rib protrudes from the plate, and is located superjacent to a pump mounting surface defined on the cylinder head. When a component located near the fuel pump is displaced toward the fuel pump and then collides with the plate of the pump cover, a load from the component acts on the pump mounting surface defined on the cylinder head through the plate and the rib of the pump cover. In other words, the load from the component is transferred from the pump cover to the pump mounting surface defined on the cylinder head. Thus, it is possible to inhibit the deformation of the plate of the pump cover toward the fuel pump due to the load. Consequently, it is possible to reduce the possibility that the pump cover will come into contact with the fuel pump due to the deformation of the pump cover and the load from the component will act on the fuel pump.

The pump cover may include a plurality of the ribs. In this case, the area of contact between the pump mounting surface and the ribs is larger than that when the pump cover includes only one rib. That is, the load from the component is transferred through the pump cover to the pump mounting surface having a large area of contact with the ribs. As a result, it is possible to decrease the load that acts per unit area on the contact surface between the pump mounting surface and the ribs when the load is transferred to the pump mounting surface.

In the pump cover, the number of the ribs may be two, and the two ribs may be provided such that the fuel pump is interposed between the two ribs. In this case, when the load from the component acts on the pump cover, the load is received by the pump mounting surface through the two ribs disposed such that the fuel pump is interposed therebetween. As a result, it is possible to effectively inhibit the plate of the pump cover from deforming toward the fuel pump due to the load from the component.

In the pump cover, the rib may be configured to extend from the pump mounting surface toward an upper end of the plate. In this case, each rib has sufficiently high strength. That is, the rib has strength high enough to smoothly transfer the load, which acts on the plate from the component, to the pump mounting surface. In other words, it is possible to avoid the situation where the load, which acts on the plate from the component, is not smoothly transferred to the pump mounting surface due to insufficient strength of the rib.

In the pump cover, a protrusion width of the rib, by which the rib protrudes from the plate, may be greatest at a portion facing the pump mounting surface, and the protrusion width may be gradually decreased in an upward direction from the pump mounting surface. In this case, the area of contact between the pump mounting surface and the rib is set as large as possible, and the space occupied by the rib is set small. Because the space occupied by the rib is set small, it is possible to prevent a decrease in the space for other components due to provision of the rib.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
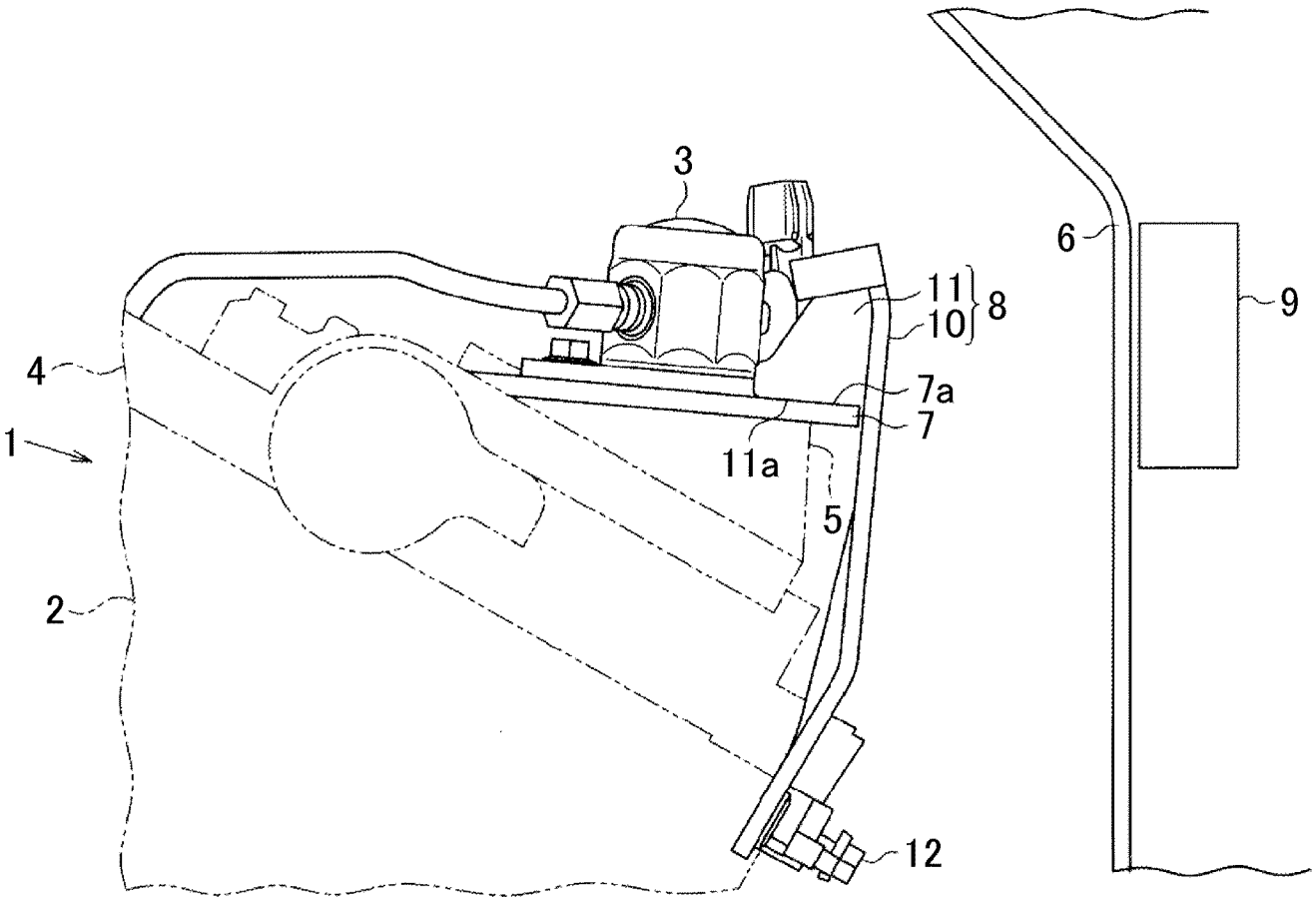
FIG. 1 is a side view illustrating a pump cover attached to an engine, according to an embodiment of the invention.

Hereinafter, a pump cover according to an embodiment of the invention will be described with reference to FIG. 1 to FIG. 5. As illustrated in FIG. 1, a fuel pump 3 is disposed on a cylinder head 2 of an engine 1 mounted on a vehicle. Specifically, a cam carrier 4 is fixed on the cylinder head 2 by tightening a bolt. A pump housing 5 is fixed on the cam carrier 4 by tightening a bolt. The fuel pump 3 is disposed on the pump housing 5 with a lifter guide 7 interposed between the fuel pump 3 and the pump housing 5. The fuel pump 3 and the lifter guide 7 are fixed to the pump housing 5 by tightening a bolt. A top surface 7*a* of the lifter guide 7 functions as a pump mounting surface on which the fuel pump 3 is mounted.

The engine 1 is provided with a pump cover 8. When components located near the fuel pump 3, such as a dashboard (i.e., a partition between an engine compartment and a vehicle cabin) 6 and a high-rigidity member 9 that are located behind the engine 1 (i.e., located on the right side of the engine 1 in FIG. 1), are displaced toward the fuel pump 3, for example, at the time of a collision of the vehicle, the pump cover 8 protects the fuel pump 3 from colliding with the dashboard 6 and the high-rigidity member 9. The pump cover 8 includes a plate 10 that is fixed to a rear side surface of the engine 1 by tightening a bolt 12. The plate 10 extends to a position lateral to the fuel pump 3 disposed on the cylinder head 2. The pump cover 8 further includes ribs 11 that protrude from the plate 10, and that is located superjacent to the pump mounting surface defined on the cylinder head 2 (i.e., the top surface 7*a* of the lifter guide 7). In the present embodiment, one side of the engine 1 or the fuel pump 3, on which the dashboard 6 is disposed, is defined as the rear side, and the opposite side of the engine 1 or the fuel pump 3 from the rear side is defined as the front side.

Figure 2:
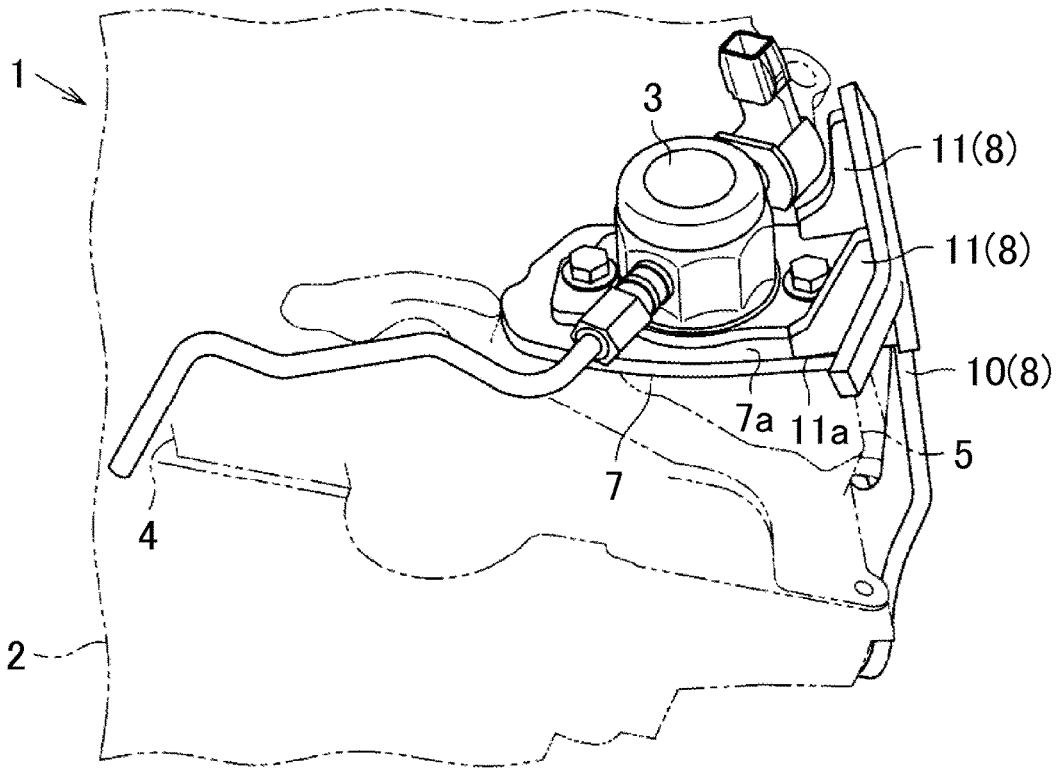
FIG. 2 is a perspective view of the pump cover according to the embodiment, as viewed from a position that is obliquely above the pump cover and behind the pump cover in the vehicle longitudinal direction.
Figure 3:
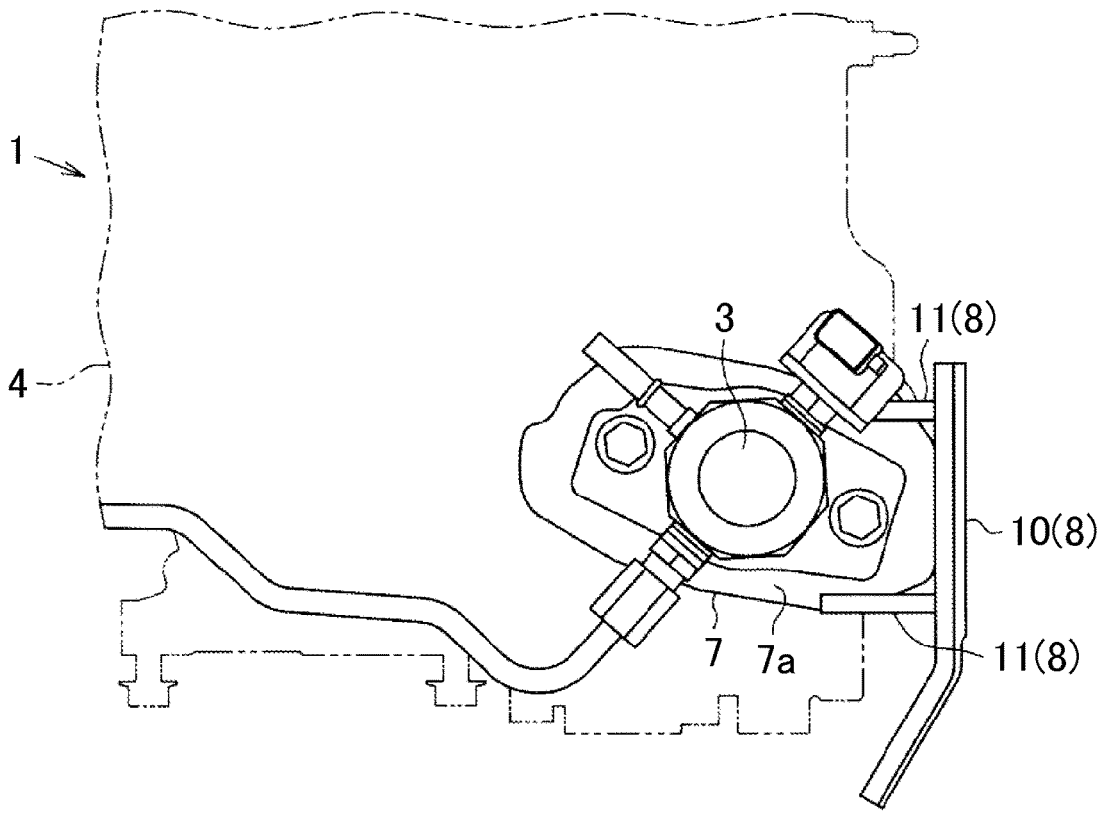
FIG. 3 is a plan view of the pump cover according to the embodiment, as viewed from above.
Figure 4:
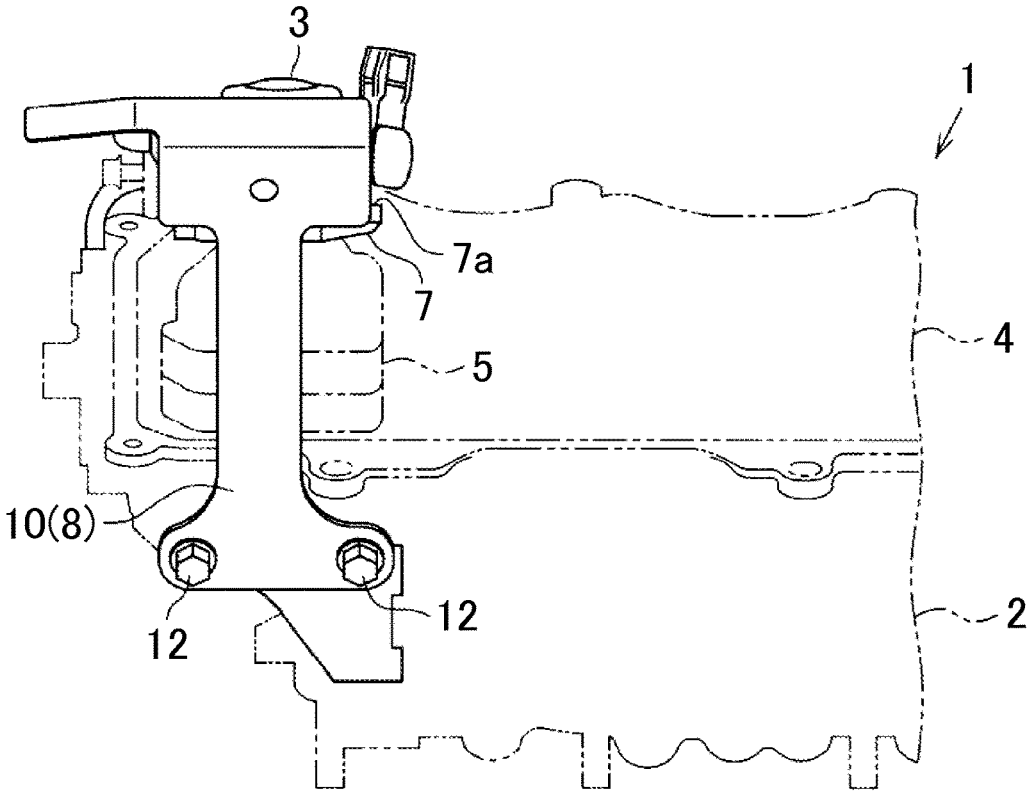
FIG. 4 is a rear view of the pump cover according to the embodiment, as viewed from a position behind the pump cover in the vehicle longitudinal direction.

FIG. 2 to FIG. 4 illustrate the pump cover 8 as viewed from directions different from the direction from which the pump cover 8 is viewed in FIG. 1. FIG. 2 is a perspective view of the pump cover 8 as viewed from a position that is obliquely above the pump cover 8 and behind the pump cover 8 in the vehicle longitudinal direction. FIG. 3 is a plan view of the pump cover 8 as viewed from above. FIG. 4 is a rear view of the pump cover 8 as viewed from a position behind the pump cover 8 in the vehicle longitudinal direction.

As illustrated in FIG. 2 and FIG. 3, the pump cover 8 includes a plurality of the ribs 11. More specifically, two ribs 11 are provided such that the fuel pump 3 is interposed between the two ribs 11 in the horizontal direction. Each rib 11 has an elongate shape and extends from the top surface 7*a* of the lifter guide 7 toward the upper end of the plate 10. The protrusion width of each rib 11, by which the rib 11 protrudes from the plate 10, is greatest at a portion that faces the top surface 7*a* of the lifter guide 7. The protrusion width of each rib 11 is gradually decreased in an upward direction (i.e., in a direction away from the top surface 7*a* of the lifter guide 7). A bottom surface 11*a* of each rib 11 is in contact with the top surface 7*a* of the lifter guide 7 while facing the top surface 7*a*.

Figure 5:
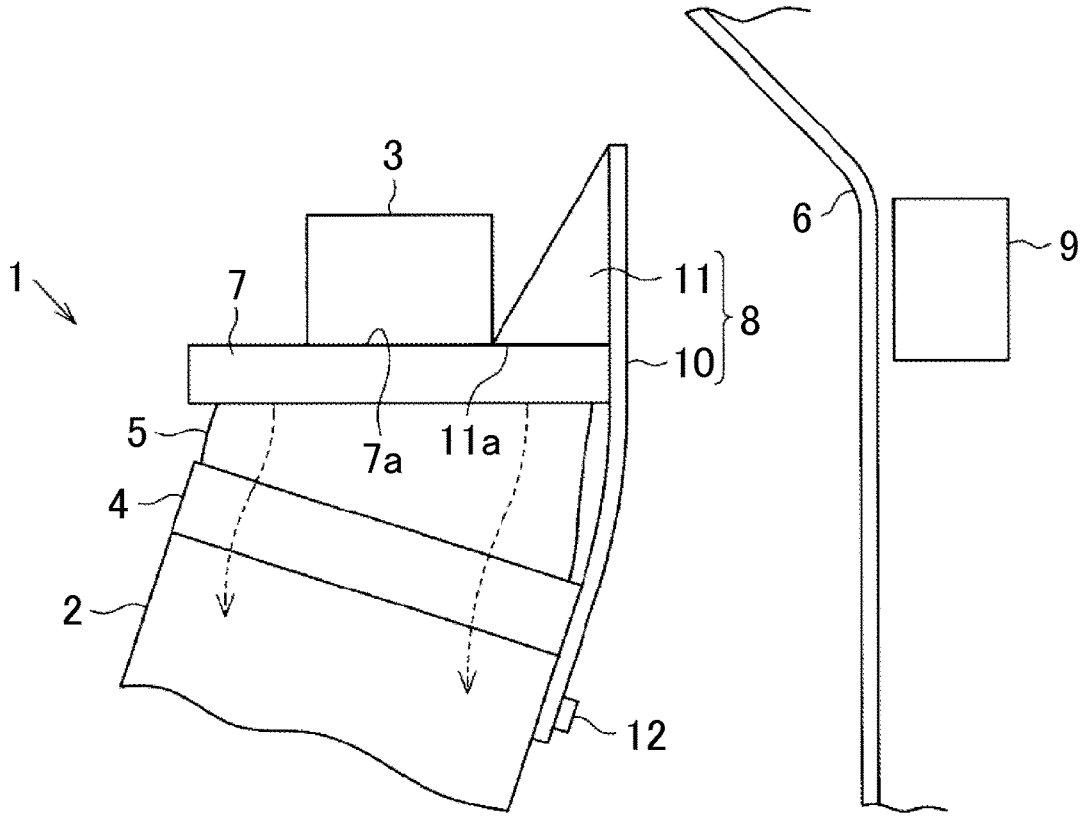
FIG. 5 is a schematic view illustrating a state where a load from a dashboard and a high-rigidity member acts on the pump cover according to the embodiment.

Next, the operation of the pump cover 8 will be described. As illustrated in FIG. 5, when the dashboard 6 and the high-rigidity member 9 located behind the engine 1 (i.e., on the right side of the engine 1 in FIG. 5) are displaced forward (i.e., toward the fuel pump 3) at the time of a collision of the vehicle and then collide with the plate 10 of the pump cover 8, a load from the dashboard 6 and the high-rigidity member 9 acts on the top surface 7*a* of the lifter guide 7 through the plate 10 and the ribs 11 of the pump cover 8. In other words, the load from the dashboard 6 and the high-rigidity member 9 is transferred to the top surface 7*a* of the lifter guide 7 through the plate 10 and the ribs 11 of the pump cover 8.

In this way, the top surface 7*a* of the lifter guide 7 functions as the pump mounting surface on which the load from the dashboard 6 and the high-rigidity member 9 acts. Note that, the pump mounting surface need not be defined directly on the top surface of the cylinder head 2. The pump mounting surface may be defined on the cylinder head 2 with, for example, the cam carrier 4, the pump housing 5 and the lifter guide 7 interposed between the pump mounting surface and the cylinder head 2. For example, the pump mounting surface may be the top surface 7*a* of the lifter guide 7, as in the present embodiment.

The load from the dashboard 6 and the high-rigidity member 9 acts on the top surface 7*a* of the lifter guide 7 (i.e., the pump mounting surface). Thus, the engine 1 receives the load, more specifically, the lifter guide 7, the pump housing 5, the cam carrier 4, and the cylinder head 2 receive the load, as indicated by arrowed dash lines. Thus, it is possible to inhibit the deformation of the plate 10 of the pump cover 8 toward the fuel pump 3 (i.e., forward) due to the load. Consequently, it is possible to reduce the possibility that the pump cover 8 will come into contact with the fuel pump 3 due to the deformation of the pump cover 8 and the load acting on the fuel pump 3 due to the contact between the pump cover 8 and the fuel pump 3 will adversely affect the fuel pump 3.

The embodiment described above in detail produces the following advantageous effects. It is possible to inhibit a load from the components (in the foregoing embodiment, the dashboard 6 and the high-rigidity member 9) located near the fuel pump 3, from acting on the fuel pump 3, for example, at the time of a collision of the vehicle. Thus, it is possible to reduce the possibility that the load will adversely affect the fuel pump 3.

The pump cover 8 includes a plurality of the ribs 11. Thus, the area of contact between the top surface 7*a* of the lifter guide 7 and the ribs 11 is larger than that when the pump cover 8 includes only one rib 11. That is, the load from the dashboard 6 and the high-rigidity member 9 is transferred through the pump cover 8 to the top surface 7*a* of the lifter guide 7 having a large area of contact with the ribs 11. As a result, it is possible to decrease the load that acts per unit area on the contact surface between the top surface 7*a* of the lifter guide 7 and the ribs 11 when the load is transferred to the top surface 7*a*.

Two ribs 11 are provided such that the fuel pump 3 is interposed between the two ribs 11 in the horizontal direction. Thus, when the load from the dashboard 6 and the high-rigidity member 9 acts on the pump cover 8, the load is received by the top surface 7*a* of the lifter guide 7 through the two ribs 11 disposed such that the fuel pump 3 is interposed therebetween. As a result, it is possible to effectively inhibit the plate 10 of the pump cover 8 from deforming toward the fuel pump 3 due to the load from the dashboard 6 and the high-rigidity member 9.

Each rib 11 has an elongate shape and extends from the top surface 7*a* of the lifter guide 7 toward the upper end of the plate 10. Thus, each rib 11 has sufficiently high strength. That is, the ribs 11 have strength high enough to smoothly transfer the load, which acts on the plate 10 from the dashboard 6 and the high-rigidity member 9, to the top surface 7*a*. In other words, it is possible to avoid the situation where the load, which acts on the plate 10 from the dashboard 6 and the high-rigidity member 9, is not smoothly transferred to the top surface 7*a* due to insufficient strength of the ribs 11.

The protrusion width, by which each rib 11 protrudes from the plate 10 of the pump cover 8, is greatest at the portion (i.e., the bottom surface 11*a*) that faces the top surface 7*a* of the lifter guide 7. Further, the protrusion width of each rib 11 is gradually decreased in the upward direction. Due to such a shape of each rib 11, the area of contact between the top surface 7*a* of the lifter guide 7 and the bottom surface 11*a* of the rib 11 is set as large as possible, and the space occupied by the rib 11 is set small. Because the space occupied by the ribs 11 is set small, it is possible to prevent a decrease in the space for other components due to provision of the ribs 11.

For example, the foregoing embodiment may be modified as follows. In the foregoing embodiment, the top surface 7*a* of the lifter guide 7 is used as the pump mounting surface, and thus the pump mounting surface is defined on the cylinder head 2 with the components such as the cam carrier 4, the pump housing 5, and the lifter guide 7 interposed between the pump mounting surface and the cylinder head 2. However, the pump mounting surface may be defined directly on the top surface of the cylinder head 2.

The bottom surface 11*a* of each rib 11 need not be in contact with the top surface 7*a* of the lifter guide 7, and a clearance may be provided between the bottom surface 11*a* and the top surface 7*a*. In this case, when the dashboard 6 and the high-rigidity member 9 collide with the plate 10 of the pump cover 8, the plate 10 is deformed by an amount corresponding to the clearance due to the load from the dashboard 6 and the high-rigidity member 9. Specifically, the plate 10 is deformed until the bottom surface 11*a* of each rib 11 comes into contact with the top surface 7*a* of the lifter guide 7. Then, in the state where the bottom surface 11*a* of the rib 11 and the top surface 7*a* of the lifter guide 7 are in contact with each other, the load from the dashboard 6 and the high-rigidity member 9 acts on the top surface 7*a* of the lifter guide 7 through the plate 10 and the ribs 11 of the pump cover 8.

The protrusion width of each rib 11, by which the rib 11 protrudes from the plate 10, is greatest at the portion facing the top surface 7*a* of the lifter guide 7, and is gradually decreased in the upward direction. However, the shape of each rib 11 is not limited to this.

Each rib 11 need not have an elongate shape extending from the top surface 7*a* of the lifter guide 7 toward the upper end of the plate 10. In the foregoing embodiment, two ribs 11 are provided such that the fuel pump 3 is interposed between the two ribs 11 in the horizontal direction. However, it is not necessary to provide the ribs 11 such that the fuel pump 3 is interposed therebetween.

The number of the ribs 11 may be three or more. The number of the ribs 11 need not be two or more, and only one rib 11 may be provided. The pump cover 8 is not limited to the pump cover that protects the fuel pump 3 from colliding with a component located behind the fuel pump 3 in the vehicle longitudinal direction. That is, the pump cover 8 may be a pump cover that protects the fuel pump 3 from colliding with a component located in front of the fuel pump 3 in the vehicle longitudinal direction, or a pump cover that protects the fuel pump 3 from colliding with a component located at a position lateral to the fuel pump 3 in the vehicle-width direction. When the pump cover 8 is used to protect the fuel pump 3 from colliding with a component located in front of the fuel pump 3 in the vehicle longitudinal direction, the pump cover 8 (i.e., the plate 10 of the pump cover 8) is fixed to a front side surface of the engine 1. When the pump cover 8 is used to protect the fuel pump 3 from colliding with a component located at a position lateral to the fuel pump 3 in the vehicle-width direction, the pump cover 8 (i.e., the plate 10 of the pump cover 8) is fixed to a side surface of the engine 1 in the vehicle-width direction.

What is claimed is:

1. A pump cover for a fuel pump, the pump cover comprising:

a plate fixed to a side surface of an engine, the plate extending to a position lateral to the fuel pump disposed on a cylinder head of the engine; and a rib that protrudes from the plate, wherein the fuel pump is disposed on an upper surface of the cylinder head in a vehicle-height direction, and the pump cover is located at a position lateral to the fuel pump, the rib is located superjacent to a pump mounting surface, and the pump mounting surface is defined on and above the cylinder head and the rib is positioned between the fuel pump and the plate such that the fuel pump is not interposed between surfaces of the rib and the cylinder head that face each other.

2. The pump cover according to claim 1, wherein the pump cover includes a plurality of the ribs.

3. The pump cover according to claim 2, wherein:

the number of the ribs is two; and the two ribs are provided such that the fuel pump is interposed between the two ribs.

4. The pump cover according to claim 1, wherein the rib is configured to extend from the pump mounting surface toward an upper end of the plate.

5. The pump cover according to claim 4, wherein:

a protrusion width of the rib, by which the rib protrudes from the plate, is greatest at a portion facing the pump mounting surface; and the protrusion width is gradually decreased in an upward direction from the pump mounting surface.

* * * * *